US005256093A

United States Patent [19]

Balstad

[11] Patent Number: 5,256,093

[45] Date of Patent: Oct. 26, 1993

[54] MARKING BUOY WITH SHOCK CORD

[76] Inventor: LeRoy Balstad, 1407 Monte Dr., Mandan, N. Dak. 58554

[21] Appl. No.: 855,275

[22] Filed: Mar. 20, 1992

[51] Int. Cl.[5] ..... B63H 21/52

[52] U.S. Cl. ..... 441/25; 441/6; 441/21

[58] Field of Search ..... 441/1, 6, 21, 23–28

[56] References Cited

U.S. PATENT DOCUMENTS

| | | | |
|---|---|---|---|
| 2,722,018 | 11/1955 | Mueller | 441/26 |
| 2,830,309 | 4/1958 | Lawson | 441/26 |
| 3,093,808 | 6/1963 | Tatnall et al. | 441/25 |
| 3,162,870 | 12/1964 | Laird | 441/25 |
| 4,781,636 | 11/1988 | Schurr | 441/26 |

*Primary Examiner*—Edwin L. Swinehart

[57] ABSTRACT

A lightweight plastic buoy with an elastic shock cord (31) attached to the nylon line (30) and lead weight (32). Included in the buoy is a plastic spool (21) attached to a metal shaft and crank (20) in a housing (11). A plastic pin (23) is attached to a foam float (24). They are found in a housing (12) near the bottom of the buoy and are moved via the admittance of water into the float chamber (25) through an orifice in the bottom cap (13). The pin (23) forces a lock (22) into notches in the spool (21) which inhibits its motion. A rubber-strap governor (27) is in contact with the top of the spool (21) controlling its velocity to eliminate the tangling of excessive line released from the spool (21).

1 Claim, 1 Drawing Sheet

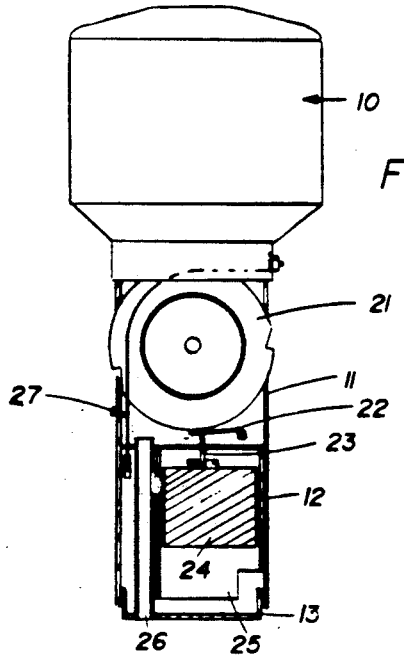
FIG. 2
FIG. 1
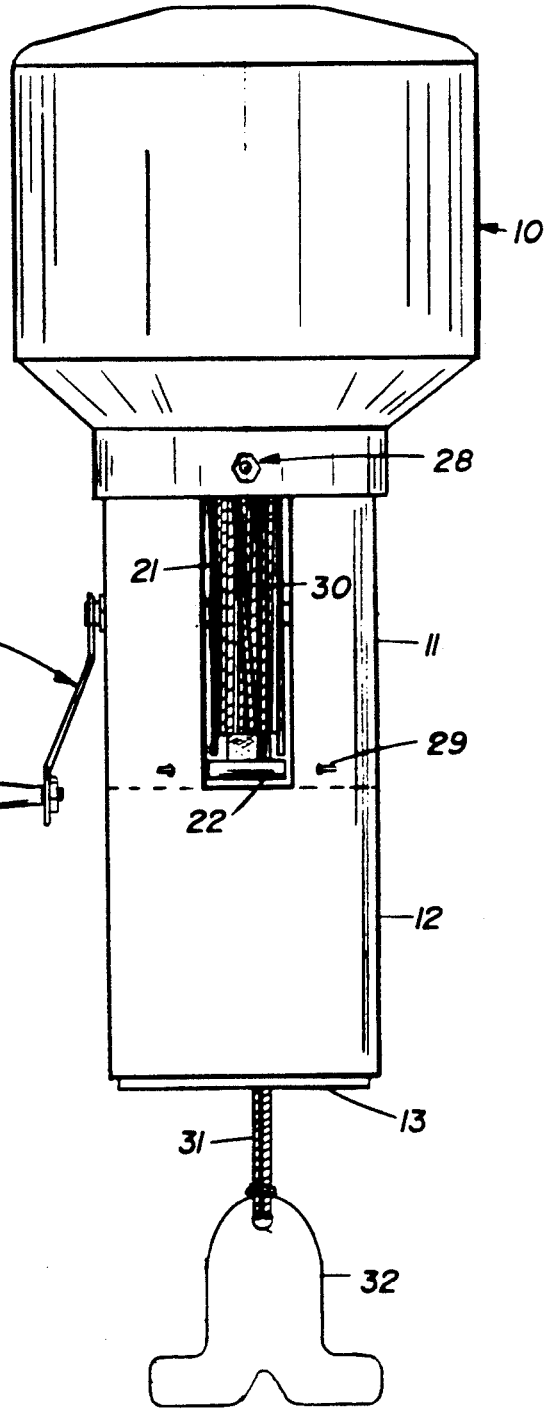
FIG. 3
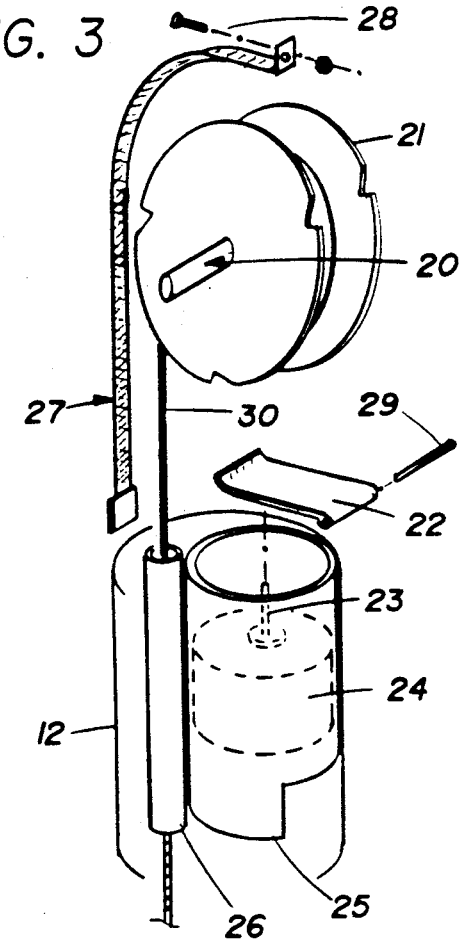

MARKING BUOY WITH SHOCK CORD

BACKGROUND—FIELD OF INVENTION

This invention relates to buoys used on the waters surface to mark underwater structures, and in particular the ability of these buoys to hold a constant relative position over said structure.

BACKGROUND DESCRIPTION OF PRIOR ART

Marking buoys are often used to map underwater structures on the water surface. These buoys consist of a anchoring weight attached to a buoyant body member. The weight takes line off of the buoy until it meets the bottom. The buoy is then anchored to the underwater location. Waves, currents, wind, and other disturbances can move the buoy on the surface of the water, causing the buoy to drift from its relative position above the desired location due to the further release of line. To solve this problem prior inventors have utilized a means to eliminate the unwanted release of line from the buoy. The buoy then will not release more line, however the disturbance will raise the buoy, cause the anchoring weight to rise off the bottom and allow the entire marker to move from the desired location.

In my search for prior art, I have found the following patents: Wolfe, U.S. Pat. No. 4,103,379; Bayles, U.S. Pat. No. 3,471,877; Davis, U.S. Pat. No. 3,827,093; Ewing, U.S. Pat. No. 3,519,983; Parker, U.S. Pat. No. 4,074,380; Faulstich et al, U.S. Pat. No. 4,004,310; Kealoha, U.S. Pat. No. 4,238,864 and Maertens, U.S. Pat. No. 4,443,203.

The prior patents describe various marker buoys using a self-contained weight and line system to mark the underwater structure on the water surface.

OBJECTS AND ADVANTAGES

Accordingly I claim the following as the objects and advantages of my invention:

(a) to provide a buoy to mark the underwater locations on the surface of the water;

(b) to provide a buoy to reliably stay in relative position to the underwater location being marked under adverse weather conditions;

(c) to provide such a buoy which requires a minimum of functional understanding or training to operate;

Additional objects and advantages are to provide a buoy which can be utilized to mark underwater objects, such as shipwrecks, divers and test equipment, and to bound underwater areas in a more efficient, and reliable method than has been available previously. Still further objects and advantages will become apparent from a consideration of the following description and the accompanying drawings.

DRAWING FIGURES

FIG. 1 shows a side view of the buoy body.

FIG. 2 is a side cutaway view of the entire marker showing the positions of the float chamber, line retrieval and lock mechanisms.

FIG. 3 shows an exploded view of the float chamber, line, line retrieval, and lock mechanisms.

| Reference Numerals in Drawings | |
|---|---|
| 10 main buoy float | 25 chamber for 24 |
| 11 housing for 21 | 26 guide for 30 |
| 12 housing for 25 and 26 | 27 governor for 21 |

-continued

| Reference Numerals in Drawings | |
|---|---|
| 13 cap for 12 | 28 screw to attach 27 to 11 |
| 20 shaft and crank for 21 | 29 shaft for 22 |
| 21 spool for 30 | 30 line |
| 22 lock for 21 | 31 shock cord attached to 30 |
| 23 pin for 22 | 32 weight for 21 |
| 24 float for 23 | |

DESCRIPTION—FIGS. 1 TO 3

A preferred embodiment of the present invention is shown in FIG. 1. The buoy is constructed of lightweight plastic. The float 10 is a hollow area of the buoy filled with a foam to keep water out. The spool housing 11 holds a line retrieval mechanism shown in FIG. 3. The float chamber housing 12 contains a lock mechanism also found in FIG. 3. The weight 32 in FIG. 1 is constructed of lead and weighs 7.5 ounces. The shock cord 31 shown in FIG. 1 is an elastic cord attached to the line 30.

FIG. 3 shows an exploded view of the line retrieval and lock mechanisms. The line retrieval mechanism centers around the spool 21. The spool 21 is constructed of a lightweight plastic or nylon and is 2.5 inches in diameter being 0.625 inches wide with a shaft and crank 20 radius of 0.75 inches permitting it to hold 60 feet of nylon line 30 and 6.5 feet of elastic shock cord 31. Mounted on a metal shaft and crank 20, the spool 21 has several notches cut into it at regular intervals. These notches are aligned with the lock 22 to prevent the rotation of the spool 21 once the lock mechanism is engaged. The lock 22 is engaged through the use of a foam float 24 and plastic pin 23. The lock 22 is mounted on a metal shaft 29. It is critical that the float 24 be constructed of a material such that water admitted through a 0.125 inch diameter aperture in the cap 13 is able to raise the float 24 and the pin 23 with force enough to engage the lock 22 and inhibit the movement of the spool 21. A vent hole 0.03 inches in diameter must be placed towards the top of the float chamber 25 to allow the escape of air for the accommodation of the incoming water. In the preferred embodiment shown in FIG. 2, the aperture in the cap 13 is located directly under the chamber 25 and is 0.105 in diameter. The governor 27 is a thin rubber or plastic strap. It must exert enough force on the spool 21 that the velocity be governed to eliminate the excessive release of line 30 once the weight 32 has contacted the bottom. In the drawings it is a rubber strap anchored by a 0.75 ounce lead weight. Another possibility is a plastic piece curved to the spool 21 held in position by a spring mounted near screw 28.

From the description above, a number of advantages of my buoy become evident:

(a) It can be operated without any training or functional understanding due to its self-contained operation.

(b) It has the ability to absorb energy from surface disturbances and remain in relative position to the underwater structure.

OPERATION—FIGS. 1 TO 3

The buoy is deployed by simply throwing it into the water over the desired location The weight 32 causes the release of the shock cord 31 and line 30 from the spool 21 due to gravity. The center of buoyancy in the buoy causes it to remain on its side while the housing 12 fills with water through an aperture placed below the initial water line in the cap 13. This influx of water causes the float 24, pin 23, and lock 22 to slowly rise and contact the spool 21. It also causes the center of buoyancy to be changed resulting in the erection of the buoy on the water surface.

While the housing 12 is filling with water the weight 32 continues to remove the shock cord 31 and line 30 from the spool 21. When the weight 32 has contacted the bottom the buoy will begin to erect itself on the water surface. The main buoy float 10 will then rise from the water surface causing the governor 27 to slow the motion of the spool 21. This will eliminate any tangling of excessive line 30 released from the spool 21 as the case in the absence of such a governor 27.

When the buoy has erected itself on the water surface the lock 22 will eventually engage the notches in the spool 21 and stop the further motion of the spool 21. The lock 22 is kept in place by the water admitted to the chamber 25 through the aperture in the cap 13 forcing the float 24 upward.

While the buoy is in position over the desired location any water surface disturbance is absorbed by the shock cord 31. The shock cord 31 stretches to facilitate the motion of the buoy on the water surface and then contracts to pull the buoy back into its relative position once the disturbance has passed.

When removing the buoy from the desired location it is removed from the water surface and held upright as in FIG. 1. The shaft and crank 20 is then used to rotate the spool 21 in a direction to wind the line back onto the spool 21. This can be done while the water is draining from the chamber 25 through the aperture in the cap 13 because it is also in a direction uninhibited by the force of the lock 22.

SUMMARY, RAMIFICATIONS AND SCOPE

Accordingly, the reader will see that the buoy embodied in this invention will enable the user to more effectively mark a desired underwater location. The buoy will absorb the energy transferred from disturbances of the water surface and enable it to be quickly repositioned over the desired location. Furthermore the buoy embodied in this invention has additional advantages in that

- it permits the rapid and effortless marking of underwater locations;
- it permits the marking of underwater locations while safeguarding itself against a problem associated with the rapid removal of line from a freely spinning spool a tangled excessively released length of line; and
- it has a means for the rapid retrieval of released line which requires no functional understanding of the buoy.

Although the description above contains many specificities, these should not be construed as limiting the scope of the invention but as merely providing illustrations of some of the presently preferred embodiments of this invention. For example, the main float may be of a different shape, the line of a different material, the spool may be replaced by a different rotary retrieval means, the main float body may be replaced or supplemented with a lightweight device to emit electro-magnetic radiation, such as an LED or radio beacon, the aperture and spool of different dimensions for different depth requirements, etc.

Thus the scope of the invention should be determined by the appended claims and their legal equivalents, rather than by the examples given.

I claim:

1. A marker buoy for marking underwater locations, said buoy comprising:

a. a generally cylindrical float body with an overall density less than that of water;

b. a separate line recovery system including a rotatable spool containing a length of line attached at one end to said spool, and an active locking system for locking said spool against rotation, c. an energy absorbing device in the form of an elastic shock cord attached at one end to the other end of the line, and attached to a weight at the other end, whereby when said weight is resting on the bottom and said active locking system has locked said reel against rotation, said elastic cord may stretch allowing said float body to move about the surface of a body of water without lifting said weight from the bottom.

* * * * *